US006520793B2

(12) United States Patent
Liang

(10) Patent No.: US 6,520,793 B2
(45) Date of Patent: Feb. 18, 2003

(54) TERMINAL CONNECTOR HAVING ARCUATELY CURVED SLOT

(76) Inventor: Yu-Ho Liang, No. 7-3, Lane 132, Ching-Hsin Street, Chung Ho City, Taipei Hsien (TW)

( * ) Notice: Subject to any disclaimer, the term of this patent is extended or adjusted under 35 U.S.C. 154(b) by 0 days.

(21) Appl. No.: 09/846,303

(22) Filed: May 2, 2001

(65) Prior Publication Data

US 2002/0164897 A1 Nov. 7, 2002

(51) Int. Cl.[7] ..... H01R 4/26
(52) U.S. Cl. ..... 439/395; 439/400; 439/396
(58) Field of Search ..... 439/395, 396, 439/399, 400, 402, 403, 404, 405, 408

(56) References Cited

U.S. PATENT DOCUMENTS 3,147,058 A * 9/1964 Zdanis ..... 439/402
3,227,991 A * 1/1966 Zdanis ..... 439/402
4,085,994 A * 4/1978 Volinskie ..... 200/238
4,283,103 A * 8/1981 Forberg et al. ..... 439/188
5,441,422 A * 8/1995 Steiner ..... 439/395

FOREIGN PATENT DOCUMENTS

JP 5-343113 * 12/1993 ..... 439/402

* cited by examiner

*Primary Examiner*—Tho D. Ta
(74) *Attorney, Agent, or Firm*—Troxell Law Office PLLC

(57) ABSTRACT

A terminal connector has a Y-shaped opening and a slot having a predetermined shape so as to have at least one protruding portion and a recessed portion, such that when a wire is inserted into the slot, the wire is able to be secured in the slot by the protruding portion.

1 Claim, 10 Drawing Sheets

TERMINAL CONNECTOR HAVING ARCUATELY CURVED SLOT

BACKGROUND OF THE INVENTION

1. Field of the Invention

The present invention relates to a terminal connector, and more particularly to a terminal connector having a predetermined slot to block the wire from going out of the slot and to deflect the wire to secure the wire inside the connector.

2. Description of Related Art

With reference to FIGS. 8 to 10, a conventional terminal connector (91) is seated in a terminal seat (92) and has a Y shaped opening (911) in a top of the terminal connector (91) and a slot (912) defined to communicate with the opening (911) and to have two arms (910) formed by the slot (912). When a wire (95) is pressed into the slot (912), the Y shaped opening (911) is able to pierce through an outer insulation (952) of the wire (95) to allow the wire (95) to be received in the slot (912). Although this kind of terminal connector (91) is able to meet the requirements, it is to be noted that a terminal seat has multiple terminal connectors and a lot of wires are thus connected with the terminal connectors. A user needs to sort out the wires before the final process. While sorting the wires (95), the pulling of the wires (95) will often cause the wires (95) to disengage with the terminal connector (91). Especially, when the wire (95) is fitted into the slot (912), the two arms (913) will expand to have a V shape, which widens the opening (911) and facilitates the disengagement of the wire (95) with the terminal connector (91).

With reference to FIGS. 11 and 12, another conventional terminal connector (96) is inserted into a terminal seat (97) in 45°. The wire (95) is inserted into the slot (962) from the top opening (961) and when the wire (95) is passing through the top opening (961), the outer insulation layer (952) of the wire (95) will be pierced through by edges of the top opening (961) and then the wire (95) is secured in the slot (962). However, when the wire (95) is inserted and secured in the slot (962), the wire (95) will be twisted by the terminal connector (96) and the terminal seat (97). That is, there are two bends (953) on the wire (95) when the wire (95) is twisted and received in the slot (962). This kind of terminal connector (96) does provide better secure to the wire (95), however, the terminal connector (96) will also cut the core (951) of the wire (95) when the wire (95) is inserted from the top opening (961). With the core (951) cut by the top opening (961), the wire (95) is also pulled by the user when the user is sorting out the wires (95) on the terminal seat (97). Accordingly, the wire (95) is easily broken while sorting. Further, when the wire (95) is fitted into the slot (962), the two arms (963) will expand to have a V shape, which also widens the top opening (961) and facilitates the disengagement of the wire (95) with the terminal connector (96).

To overcome the shortcomings, the present invention intends to provide an improved terminal connector to mitigate or obviate the aforementioned problems.

SUMMARY OF THE INVENTION

The primary objective of the invention is to provide an improved terminal connector having a slot with a predetermined shape so as to deflect the wire with respect to the longitudinal axis of the terminal connector.

Another objective of the invention is to provide a terminal connector having a meanderline slot. That is, the slot has at least one bend to meet the requirement to secure the wire inside the slot.

Other objects, advantages and novel features of the invention will become more apparent from the following detailed description when taken in conjunction with the accompanying drawings.

DETAILED DESCRIPTION OF PREFERRED EMBODIMENT

Figure 1:
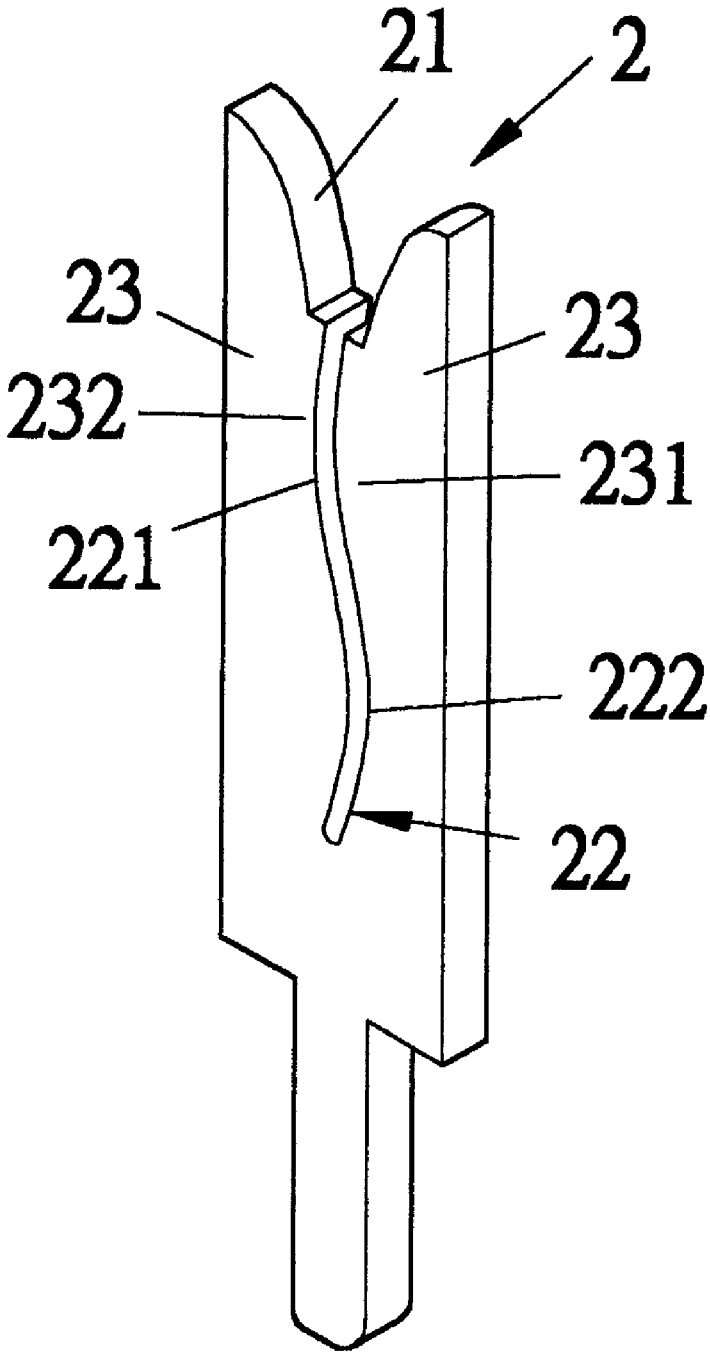
FIG. 1 is a perspective view of a terminal connector constructed in accordance with the present invention.
Figure 2:
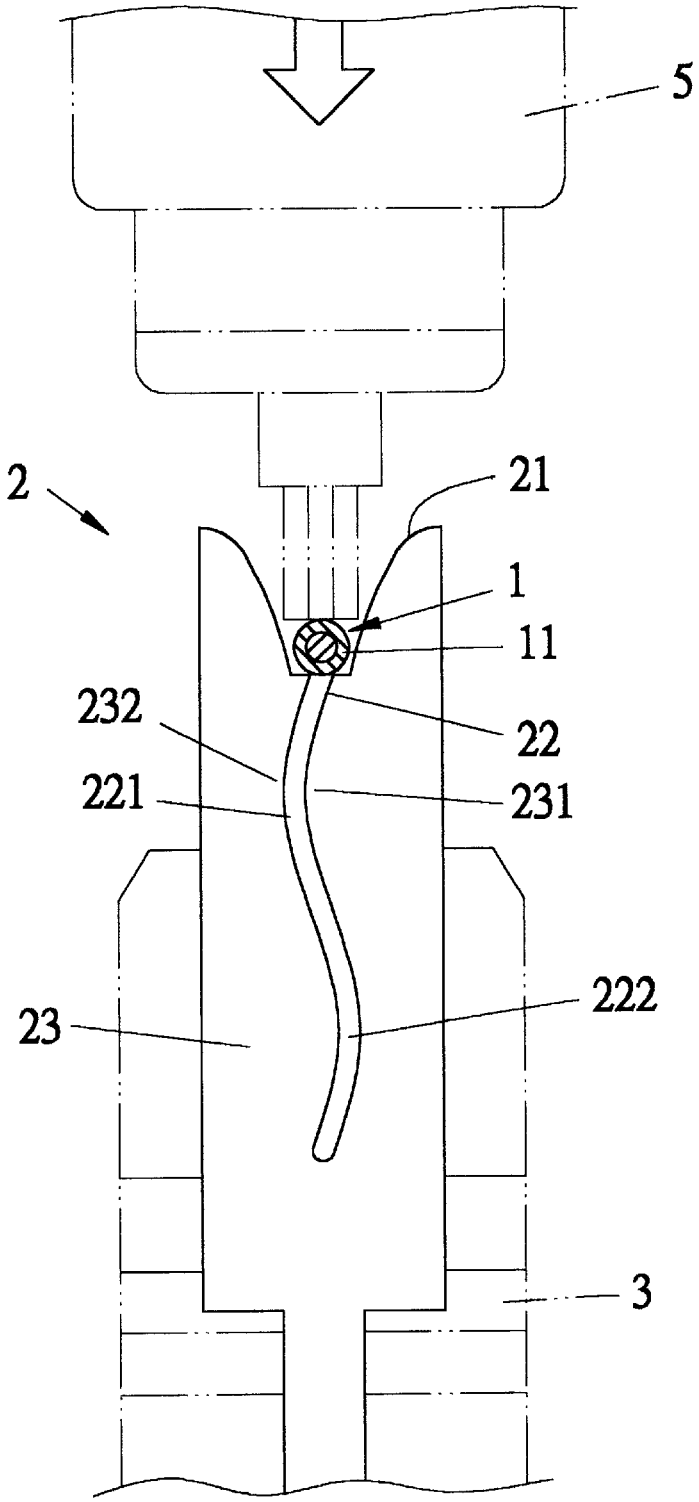
FIG. 2 is an operational plan view showing the wire before entering the slot in the terminal connector of FIG. 1.
Figure 3:
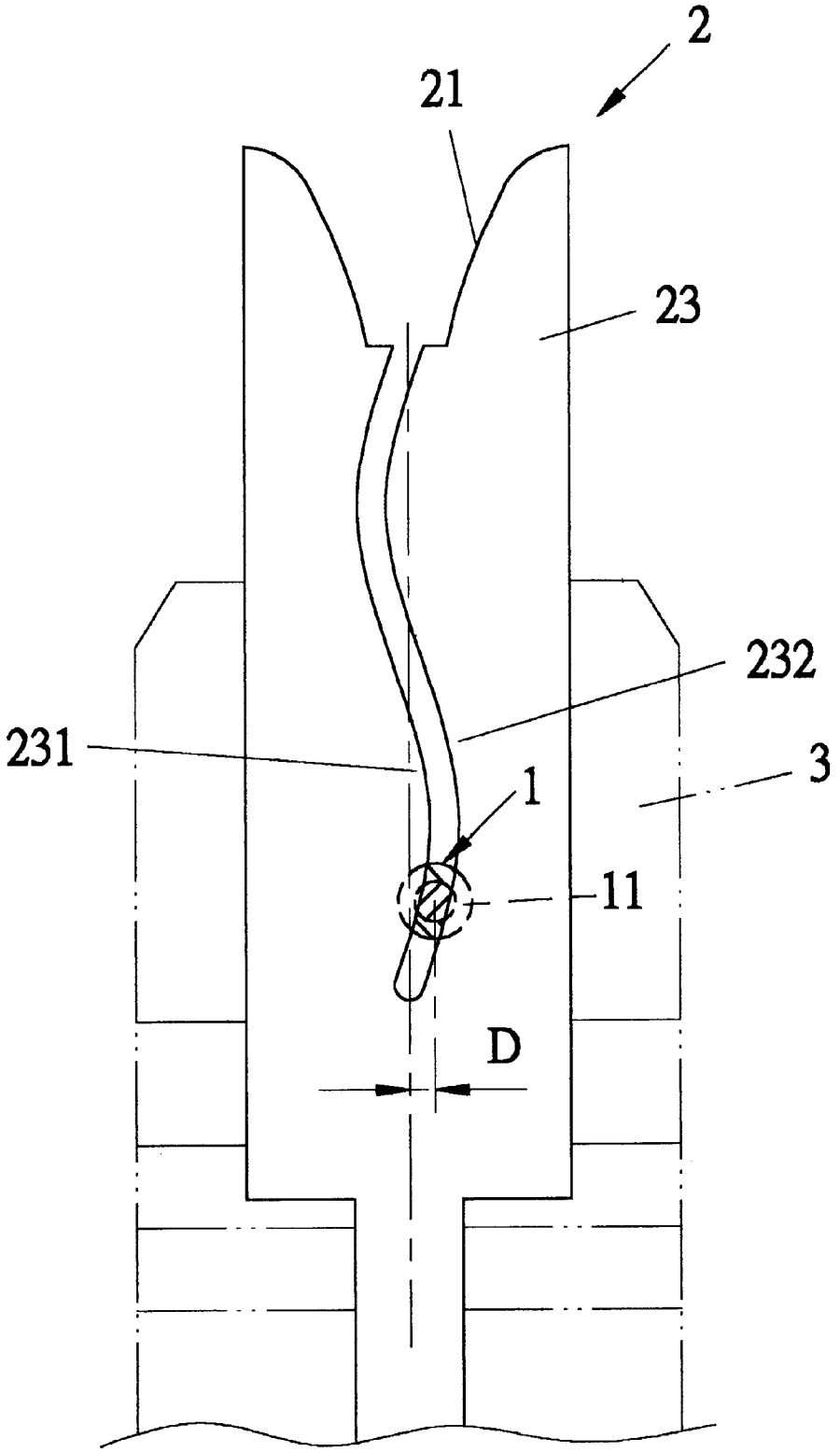
FIG. 3 is a schematic plan view showing the wire is inserted into the slot.
Figure 4:
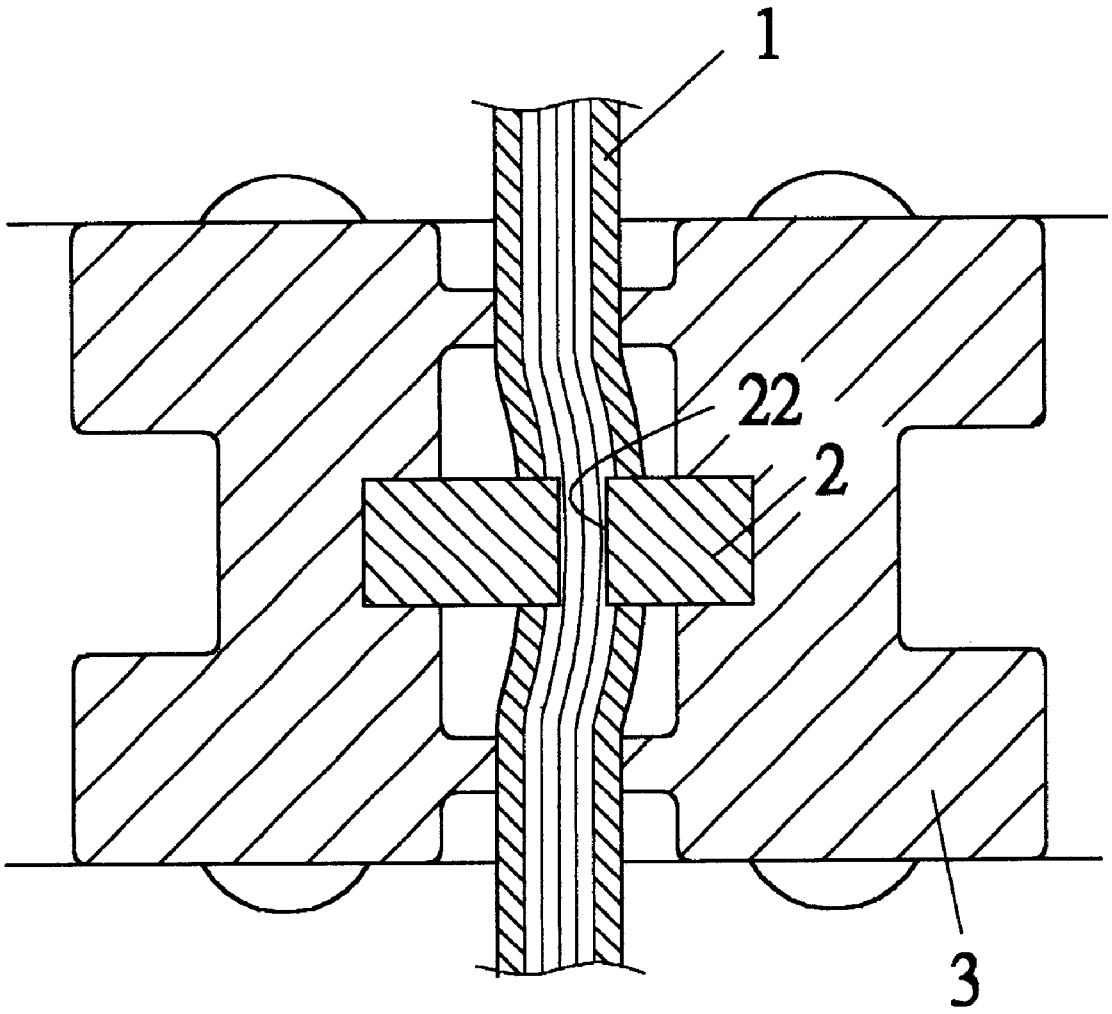
FIG. 4 is a cross sectional view showing the wire is being secured inside the slot.

With reference to FIGS. 1 to 4, the terminal connector (2) in accordance with the present invention is inserted into a terminal seat (3) and has a Y-shaped opening (21) and a meanderline slot (22) defined to communicate with the opening (21) so as that the terminal connector (2) has two arms (23) separated by the slot (22). When a wire (1) is inserted through the opening (21) by a tool (5), the opening (21) will cut through outer insulation layer (11) and only the core (not numbered) of the wire (1) is allowed to be inserted into the slot (22). Because the slot (22) is meanderline shaped, which allows the terminal connector (2) to have at least one protruding portion (231) and one recessed portion (232). Accordingly, when the wire (1) is inserted into the slot (22), the protruding portion (231) will block the wire (1) from going out of the slot (22). In the preferred embodiment of the invention, the slot (22) is defined by two arcs (221,222) respectively formed on opposite sides with respect to each other. Furthermore, the protruding portion (231) pushes the wire (1) away from the center line of the opening (21) for a distance D to enhance the secure to the wire (1) in the terminal connector of the present invention. Therefore, even though when the wire (1) is inserted into the slot (22) to widen the arms (23), the wire (1) can still be secured in the slot (22).

Figure 6:
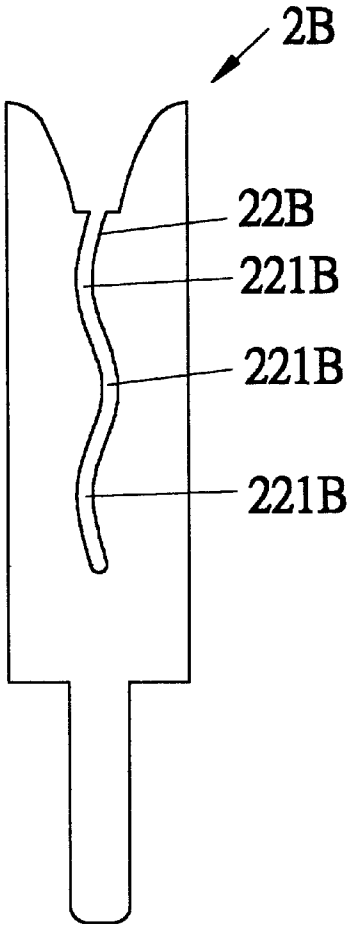
FIGS. 5 and 6 are plan views of a second and third preferred embodiments of the present invention.
Figure 5:
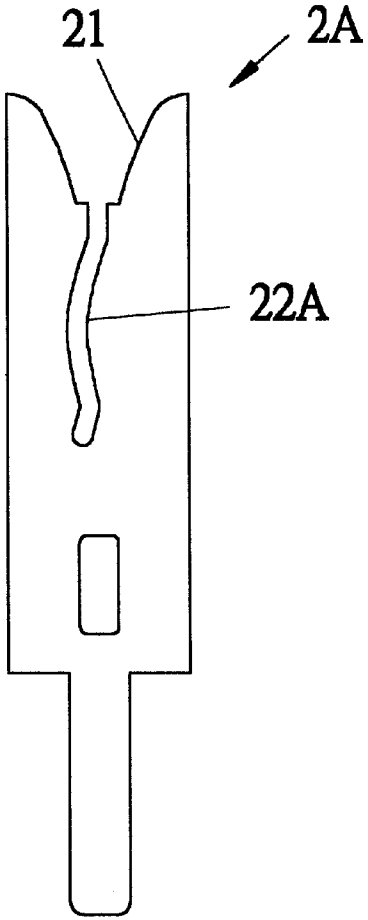

A second preferred embodiment is shown in FIG. 5, wherein the slot (22A) of the terminal connector (2A) has only one arcuate portion. A third preferred embodiment of the present invention is shown in FIG. 6, wherein the slot (22B) of the terminal connector (2B) has continuous arcuate portions (221B).

Figure 7:
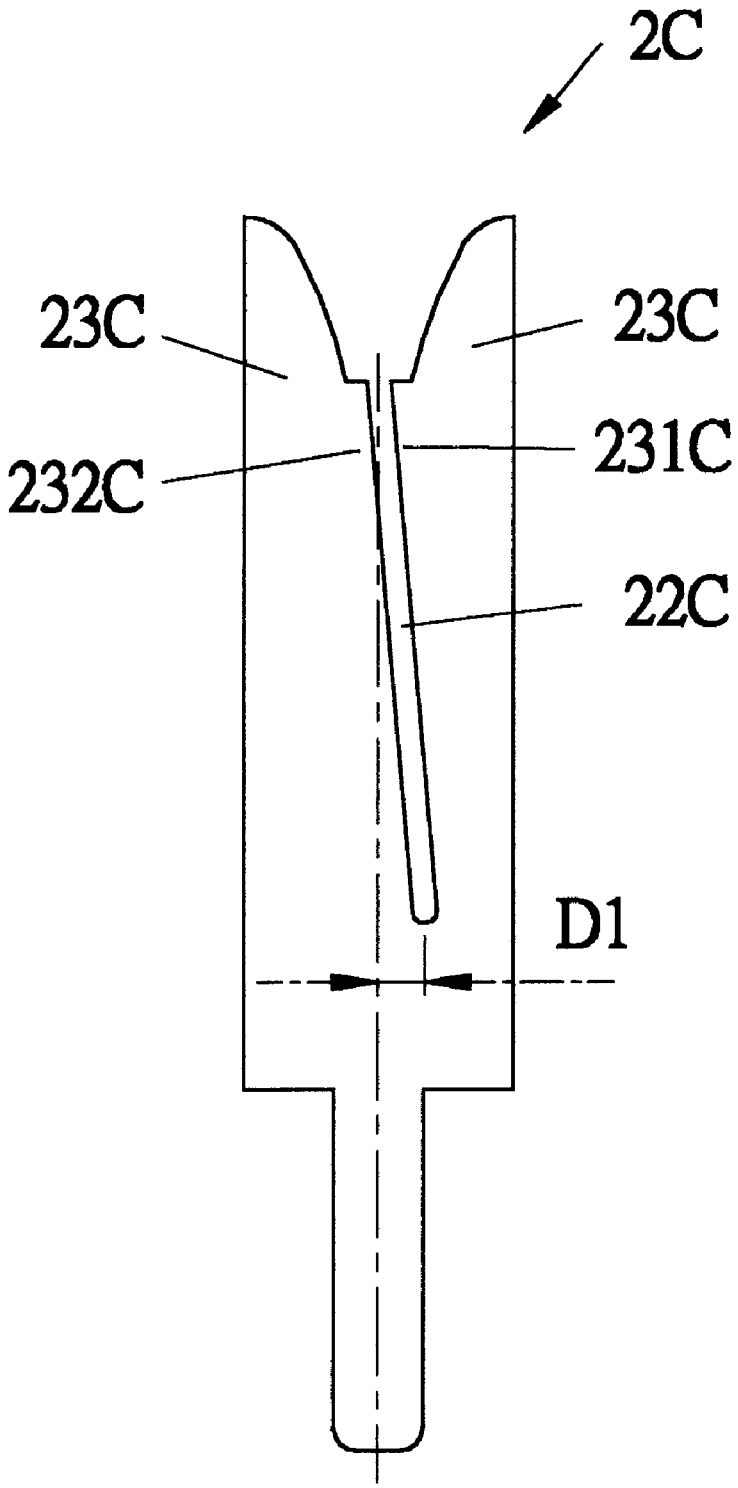
FIG. 7 is a plan view of a fourth preferred embodiment of the present invention.
Figure 9:
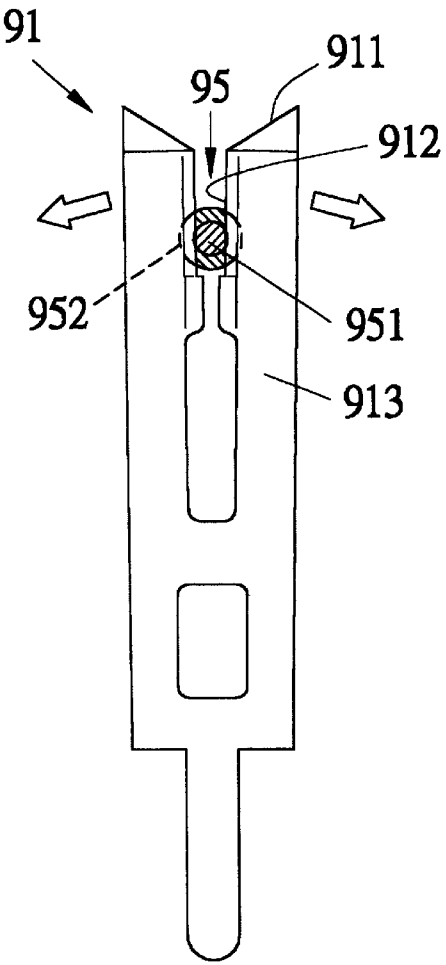
FIG. 9 (Prior Art)
FIG. 9 is a plan view showing the wire is inserted into the slot of the conventional terminal connector of FIG. 8.
Figure 8:
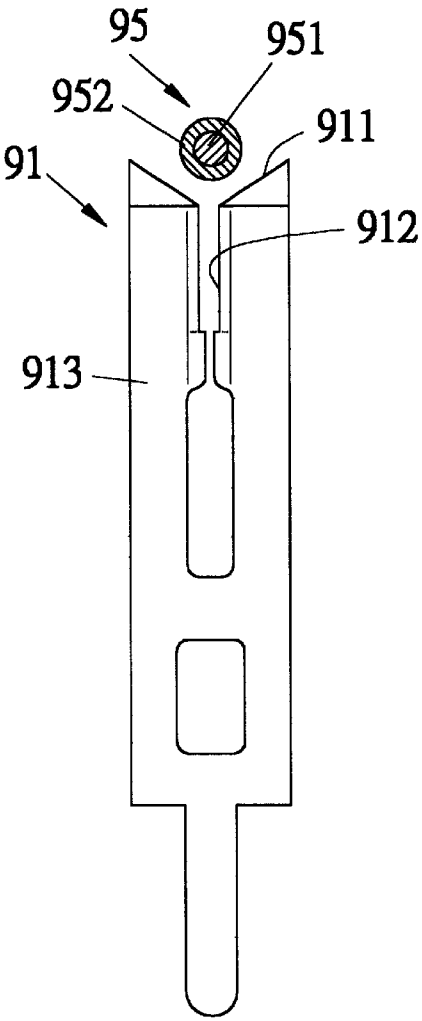
FIG. 8 (Prior Art)
FIG. 8 is a plan view of a first conventional terminal connector.
Figure 10:
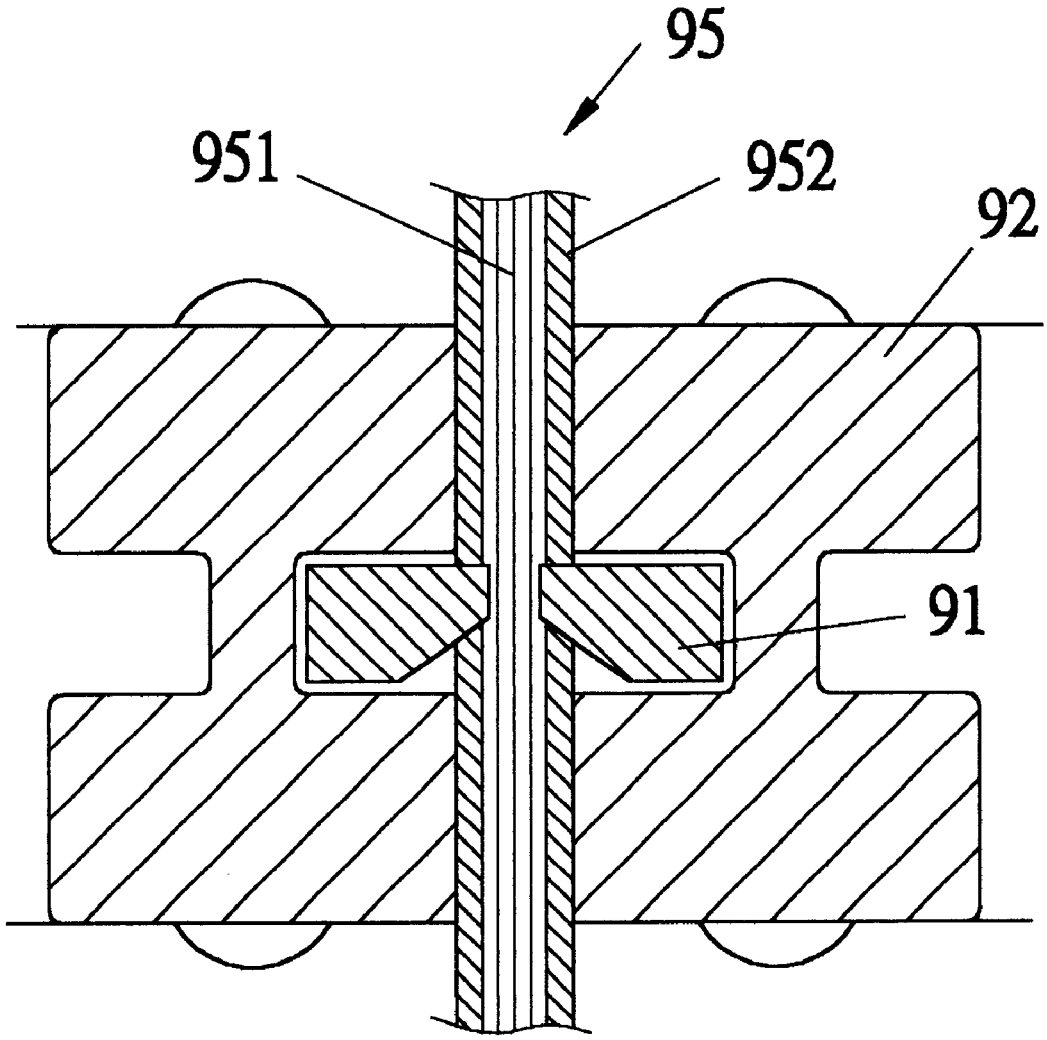
FIG. 10 (Prior Art)
FIG. 10 is a schematic cross sectional view showing the wire is secured inside the slot of the terminal connector of FIG. 8.
Figure 11:
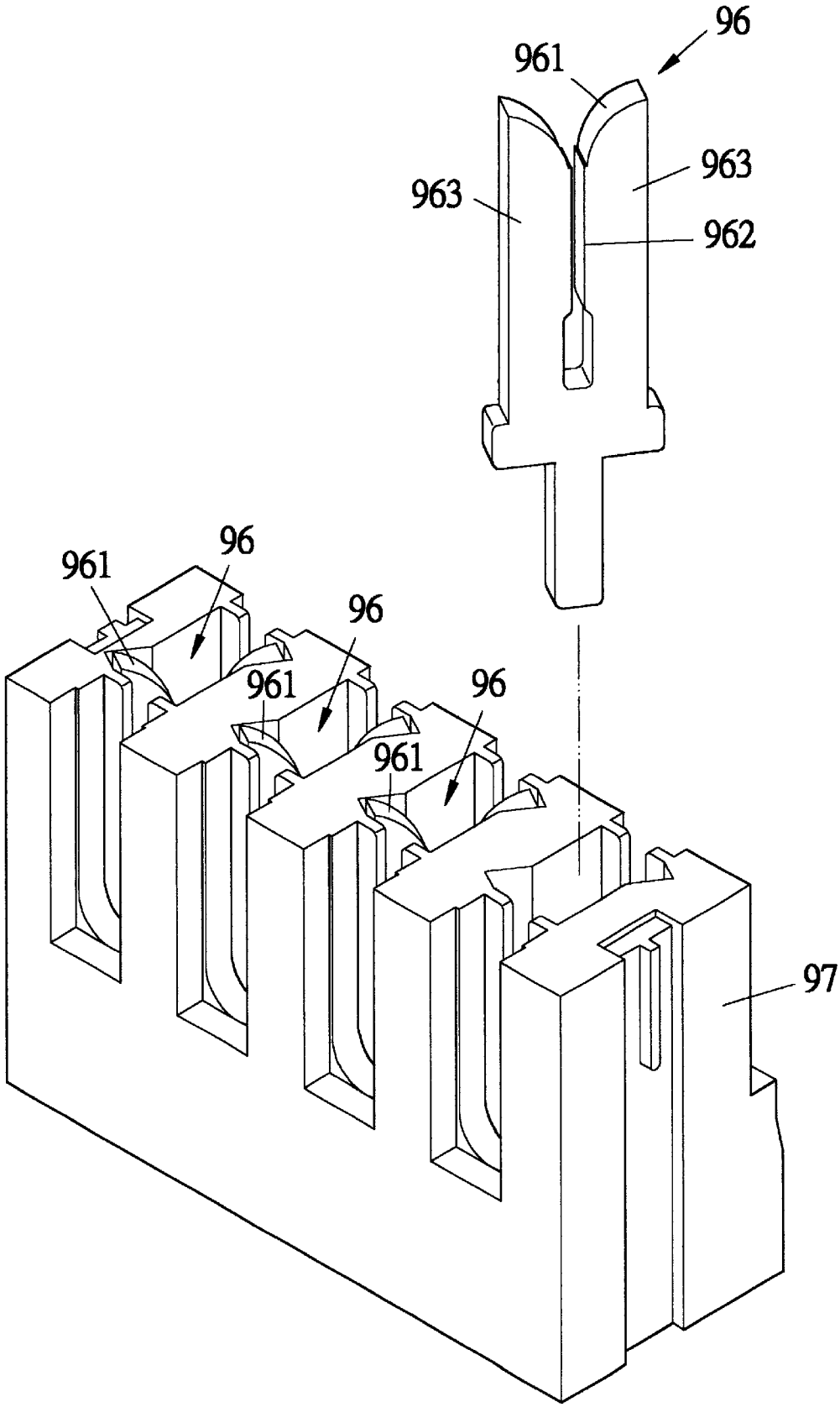
FIG. 11 (Prior Art)
FIG. 11 is an exploded perspective view of a second conventional terminal connector and the terminal seat corresponding to the terminal connector.
Figure 12:
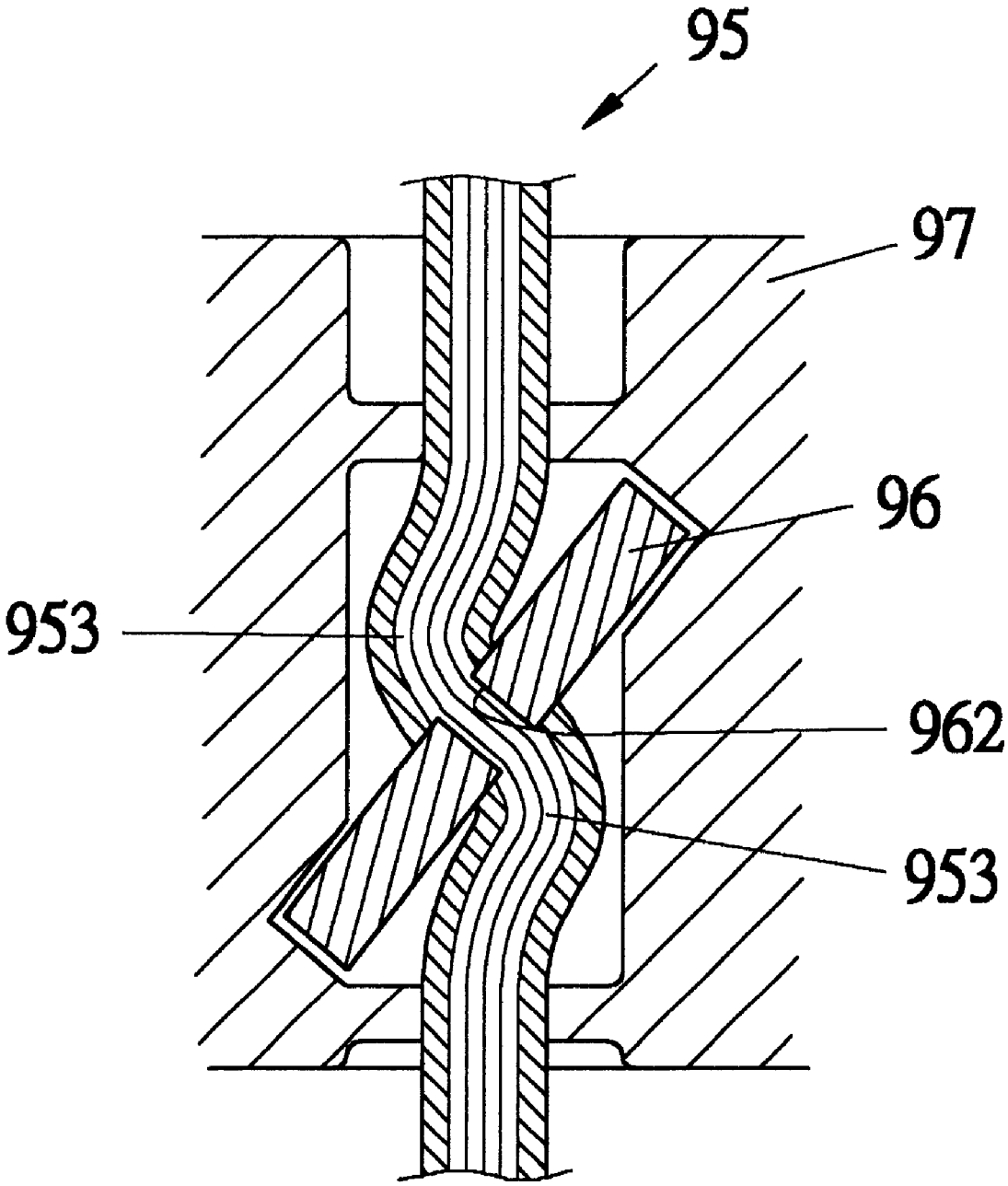
FIG. 12 (Prior Art)
FIG. 12 is a schematic cross sectional view showing the wire is being secured in the slot of the second conventional terminal connector.

With reference to FIG. 7, the fourth preferred embodiment of the present invention is shown, wherein the terminal connector (2C) has a slanted slot (22C), which deviates the wire for a distance D1 larger than the distance D as described earlier. The terminal connector (2C) also has two arms (23C) and thus forms a protruding portion (231C) and a recessed portion 232C).

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A terminal connector comprising: two flat, coplanar arms, located adjacent to each other, the arms having first ends forming therebetween an opening; a slot between the arms, so as to space the arms apart, the slot having a first end in communication with the opening and a second end, the slot having a plurality of adjacent portions, each portion being arcuately curved in a direction opposite to a curvature of an adjacent portion along an entire distance between the first and second ends of the slot.

* * * * *